US005498117A

United States Patent [19]

Nezu

[11] Patent Number: 5,498,117

[45] Date of Patent: Mar. 12, 1996

[54] DEVICE FOR SIDETRACKING A TRUCK

[75] Inventor: Takashi Nezu, Akishima, Japan

[73] Assignee: Tachi-S Co., Ltd., Tokyo, Japan

[21] Appl. No.: 294,833

[22] Filed: Aug. 29, 1994

[51] Int. Cl.[6] ..... B65G 37/00

[52] U.S. Cl. ..... 414/355; 414/222; 414/660

[58] Field of Search ..... 414/355, 356, 414/609, 222, 630, 659, 600, 662; 180/168; 104/262, 273; 198/346.1, 346.2

[56] References Cited

U.S. PATENT DOCUMENTS

| | | | |
|---|---|---|---|
| 2,845,189 | 7/1958 | Sanders | 414/660 |
| 3,517,845 | 6/1970 | Martin | 414/662 |
| 4,051,955 | 10/1977 | Kaffka | 198/346.2 |
| 4,189,277 | 2/1980 | Klose | 414/222 |
| 4,553,896 | 11/1985 | Yoshida | 414/222 |
| 4,664,590 | 5/1987 | Maekawa | 180/168 |
| 4,867,297 | 9/1989 | Saitoh et al. | 198/346.2 |
| 4,999,578 | 3/1991 | Ohashi et al. | 198/346.2 |
| 5,006,028 | 4/1991 | Jackson | 414/222 |
| 5,085,553 | 2/1992 | Bouwens et al. | 414/222 |
| 5,350,077 | 9/1994 | Nezu . | |

*Primary Examiner*—Michael S. Huppert
*Assistant Examiner*—Thomas J. Brahan
*Attorney, Agent, or Firm*—Browdy and Neimark

[57] ABSTRACT

A device for sidetracking a truck, which basically comprises a movable actuator element operable in a direction to and from the truck, a carriage connected to the movable actuator element, on which the truck is to be placed, the carriage means being provided, on an upper side thereof, with a lifting element for raising the truck so as to raise the truck from a floor, and a stationary actuator element connected to the movable actuator element, the stationary actuator element being extendable and retractable in a direction along the direction wherein the movable actuator means is operated with respect to the truck. With such a simple structure, the truck may be sidetracked, even in a direction orthogonal with the path along which the truck moves.

The carriage may have a storage space defined therein and the stationary actuator element may include a storage bracket, so that when in no use, all the elements may be bodily or partially juxtaposed together in such storage elements, thereby making smaller and compact the body of the device.

12 Claims, 4 Drawing Sheets

DEVICE FOR SIDETRACKING A TRUCK

BACKGROUND OF INVENTION

1. Field of the Invention

The present invention relates to a device for sidetracking a truck, and particularly to a device for uncoupling and sidetracking a carrying truck from an unmanned self-propelled truck towards a predetermined position, as used in an assembly shop or a storehouse.

2. Description of Prior Art

Recently, most of assembly shops or storehouses are equipped with a fully automated system for trasferring a loading or baggage to several predetermined positions, using a self-propelled truck and a carrying truck coupled therewith. For instance, the Japanese Patent Laid-Open Pub. No. 4-328008 discloses a typical example of self-propelled and carrying trucks, and a method for uncoupling the former from the latter in an automatical way. As suggested in this prior art, a self-propelled truck moves, trailing a carrying truck therebehind, along a given running path in which a light reflecting tape is adhered on a floor. The self-propelled truck automatically moves on the running path, with its light sensor detecting the light reflecting tape, and will be uncoupled from a carrying truck at a predetermined uncoupling point.

However, as a preferred mode in such uncoupling operation, there is a sidetracking system available for uncoupling and sidetracking a carrying truck from a given running path where a leading self-propelled truck moves, in a direction towards a given sidetracked point. In this sort of system, the carrying truck must be uncoupled and displaced from the running path in a direction orthogonal therewith. Consequently, the system per se inevitably becomes a large-scale construction with complicated mechanical elements which results in occupying much of room and space in the assembly shop or storehouse.

SUMMARY OF THE INVENTION

It is a primary purpose of the present invention to provide an improved device for sidetracking a truck which is structurally simplified.

To achieve such purpose, a device for sidetracking a truck, in accordance with the present invention, is basically comprised of:

- a movable actuator means operable in a direction to and from the truck;
- a carriage means connected to the movable actuator means, on which carriage means the truck is to be placed, the carriage means being provided, on an upper side thereof, with a lifting means for raising the truck so that the caster of the truck may be raised away from a floor; and
- a stationary actuator means connected to the movable actuator means, the stationary actuator means being extendable and retractable in a direction along the direction wherein the movable actuator means is operated with respect to the truck;

Accordingly, operable portions are only those four basic elements: The stationary actuator means is extended and retracted to cause the movable actuator means to be operated towards and from the truck, thereby setting the carriage under the truck and sidetracking the turck, with the lifting means raising the truck from the floor. This permits those elements to be operated in a direction orthogonal with a path along which the truck moves.

Another purpose of the invention is to avoid occupying of the sidetracking device in much room or space.

To this end, in the above-described basic construction of the invention, a storage space may be defined in the carriage means, and a storage bracket means may be provided at the stationary actuator means, such that when the device is inoperative, the movable actuator means is stored in the storage bracket means of the stationary actuator means and further both movable and stationary actuator means are stored in the storage space of the carriage means, thereby making compact the whole body of the device, whereas when the device is used, the same operations as above for the stationary and movable actuator means are effected.

Other features and advantages of the present invention will become apparent from reading of description hereinafter, with respect to the drawings.

DETAILED DESCRIPTION OF PREFERRED EMBODIMENT OF THE INVENTION

Figure 1:
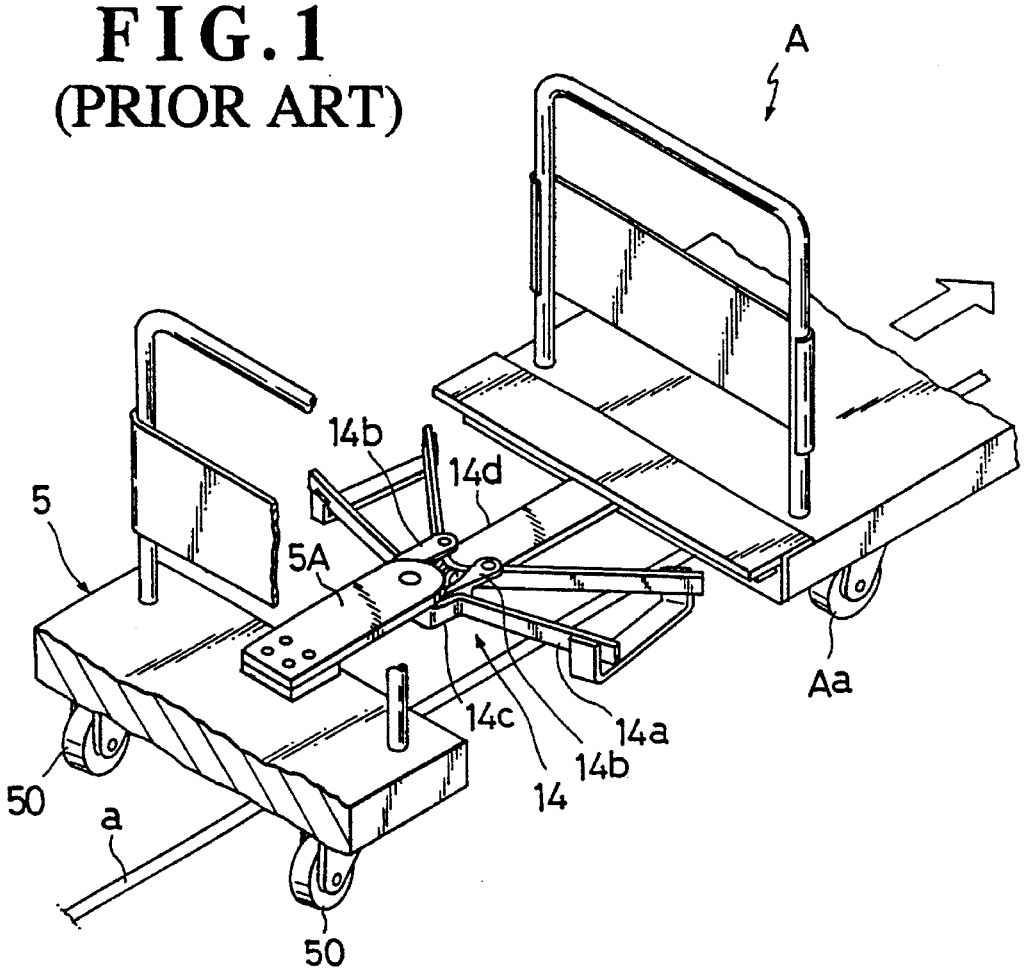
FIG. 1 (PRIOR ART)
FIG. 1 is a partly broken perspective view of a self-propelled truck and a carrying truck coupled therewith, to which the present invention is applied.
Figure 2:
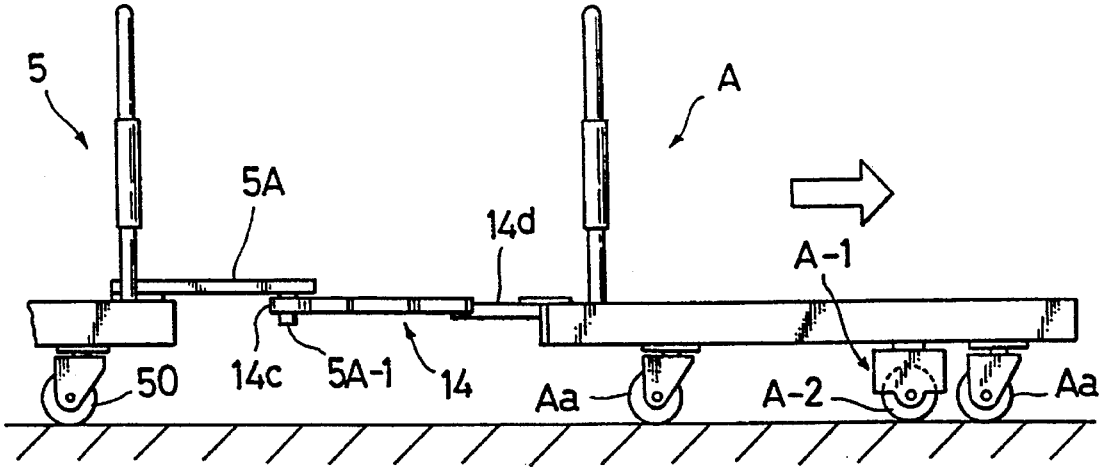
FIG. 2 (PRIOR ART)
FIG. 2 is a partly broken side view of those trucks in FIG. 1.

FIGS. 1 and 2 show a conventional combination of a self-propelled truck (A) and a carrying truck (5).

The self-propelled truck (A) with casters (Aa) moves and stops automatically, in unmanned way, along a given running path (D) (see FIG. 3), under the guidance of a light sensor drive element (A-1) detecting a light reflecting tape (a) adhered along the path (D). The light sensor drive element (A-1) includes a driving wheel (A-2) which controls movement and change of direction of the truck (A) along the tape (a). Fixed to the rearward end side of such truck (A) is a generally T-shaped female coupler (14) which comprises a support plate member (14*d*), two laterally projected engagement sections (14*a*) and a central female engagement section (14*c*).

The carrying truck (5) is provided, at the forward end side, with a male coupler (5A) having a downwardly projected pin (5A-1). In brief, when coupling the carrying truck (5) with the self-propelled truck (A), such downwardly projected pin (5A-1) of carrying truck (5) is slidingly introduced along one of the two laterally projected engagement sections (14*a*) of the female coupler (14) into the central female engagement section (14*c*) of the same. But, when uncoupling the carrying truck (5) from the self-propelled truck (A), it is required to raise the carrying truck (5) for upward disengagement of its pin (5A-1) from that female engagement section (14*c*) of self-propelled truck (A) and then sidetrack the carrying truck (5) to a predetermined position.

Figure 3:
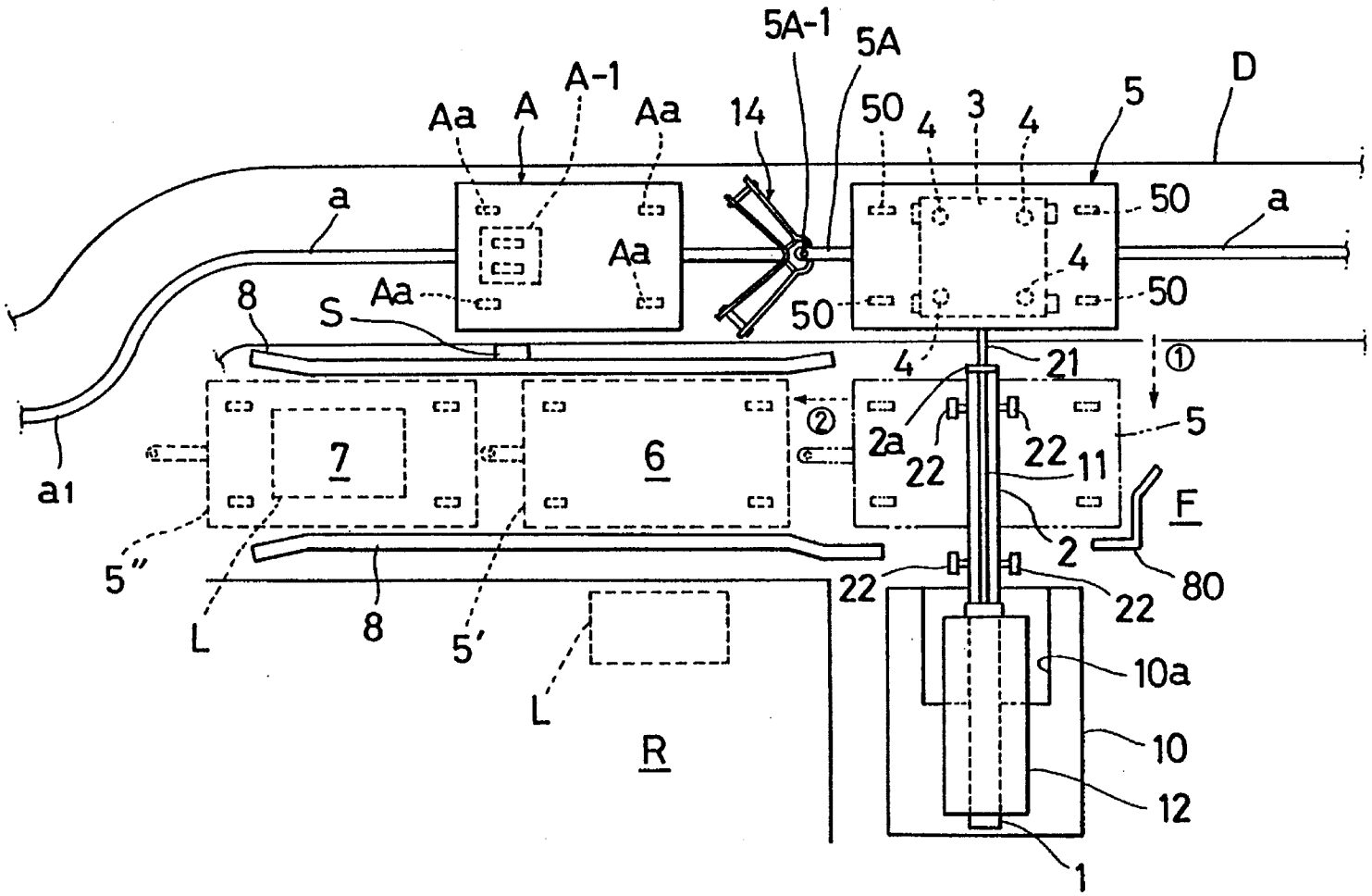
FIG. 3 is schematic plan view showing a disposition of a device for sidetracking the carrying truck in accordance with the present invention.

In accordance with the present invention, as shown in FIG. 3, there is provided a device (10) for uncoupling and sidetracking the carrying truck (5) from the self-propelled truck (A). FIG. 3 schematically illustrates a whole system which includes such device (10), a principle part of the present invention, and further a robot-controlled loading and coupling section (6, 7, 8 and R). In brief, the operation of the whole system is such that the unloaded carrying truck (5), as indicated by the tow-dot chain line, is sidetracked and drawn to a given position which is partially defined by a sidetracking guide wall (80), and then, as indicated by phantom lines, the carrying truck (at 5') is transferred to a loading point (6), where a load or baggage (L) is placed on the truck (5), and set at a coupling point (7) where the loaded carrying truck (at 5") is to be coupled with the female coupler (14) of the self-propelled truck (A) which reaches the curved area (at a1 ) of the running path (D). The sequences of such loading and coupling operations are automatically effected by a robot (R), but this is not a principle part of the present invention and no detailed explanation is given thereon. Also, the specific coupling actions between the two trucks (A)(5) at that coupling point (7) are not the principle part of the present invention and already disclosed in the U.S. patent appln. Ser. No. 8/075,091 (which is allowed) assigned to the assignee of the present application. Reference should thus be made thereto for further information.

Designations (8)(8) denote a pair of spaced-apart guide walls between which the carrying truck will be guide for the foregoing loading and coupling purposes. Designation (S) stands for a sensor provided on one of those two guide walls (8)(8) which is situated adjacently along the running path (D). The sensor (S) is electrically connected with the sidetracking device (10) so that when the self-propelled truck (A) trailing the carrying truck (5) comes in the present whole system, the sensor (S) detects it and sends a signal for operating the sidetracking device (10).

Though not shown, the robot (R) includes a computerized control device (i.e. central processing unit, other related circuitry and the like), which of course processes the signal emitted from the foregoing sensor (S) and actuate the sidetracking device (10) of the present invention.

As shown, the carrying turck (5) is coupled with the self-propelled truck (A), such that the downwardly projected pin (14) of the former is engaged in the central female engagement section (14*c*).

Referring to FIGS. 3 through 9, there is illustrated a preferred embodiment of the sidetracking device (10) in accordance with the present invention, The sidetracking device basically comprises: a housing (at 10); a carriage storage section (10*a*) defined in one side of the housing; a stationary cylinder (1) fixed on a floor (F); a movable cylinder (2) connected to the cylinder rod (11) of the stationary cylinder (1); and a carriage (3) connected to the cylinder rod (21) of the movable cylinder (2). The two cylinders (1)(2) are actuated in sequence one after another to provide a telescopic motion of the corresponding two cylinder rods (11)(12) to locate and retract the carriage (3) at and from a point in the running path (D) where the carrying truck (5) reaches, as generally understandable from FIGS. 4 to 7, which will however be described in details later.

As can be seen in FIG. 3, the housing, in which the foregoing constituent elements are normally stored when the present device are inoperative, is oriented towards the running path (D) in a direction orthogonal therewith and located at a point from the central longitudinal axis in the path (D), a distance substantially equal to a total length of the two extended-up cylinder rods (11)(12) respectively of the stationary and movable cylinders (1)(2).

Figure 4:
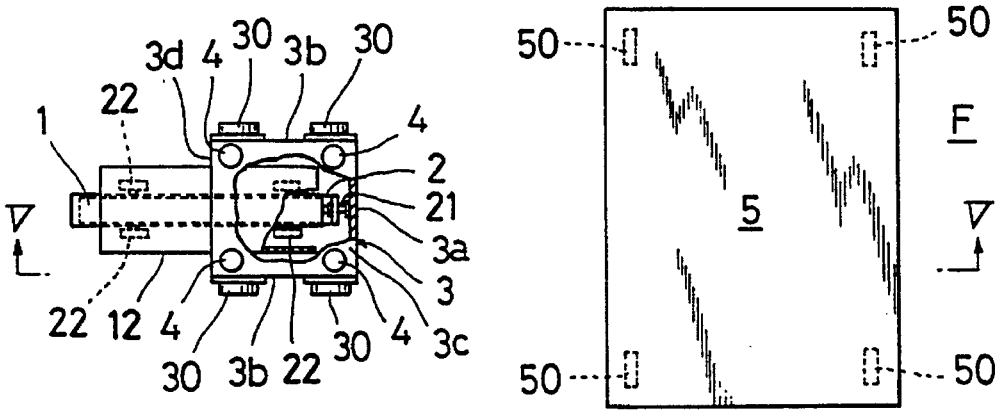
FIG. 4 is a plan view showing a disposition of the sidetracking device with respect to the carrying truck.
Figure 5:
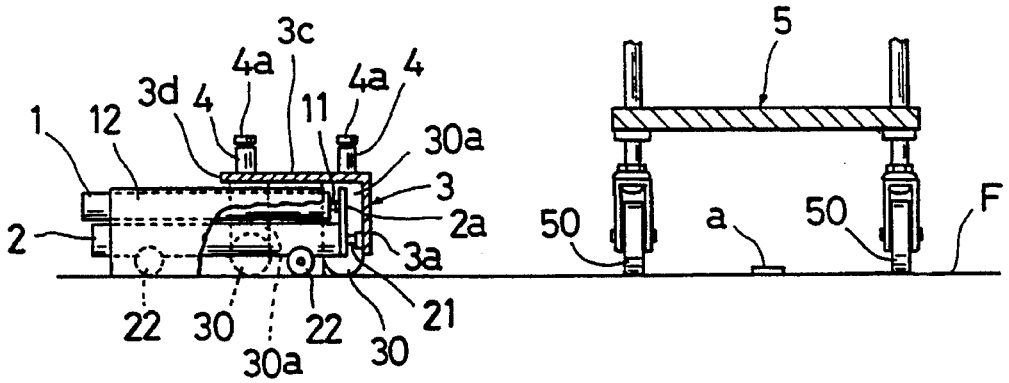
FIG. 5 is a sectional view taken along the line V—V in FIG. 4.

Designation (12) represents a generally inverted-U-shaped storage bracket in which to store the movable cylinder (2), having two spaced-apart lateral vertical walls fixed on the floor (F) and a top wall integrally extended between those two vertical walls. As best seen in FIGS. 4 and 5, the stationary cylinder (1) is fixed to the inner side of the top wall of that storage bracket (12) and supported thereby at a height above the movable cylinder (2) which is stored in the bracket (12), without contact and interference between the two cylinders (1)(2). Hence, the height of the storage bracket (12) should be of a height more than a total height of the two juxtaposed cyliners (1)(2).

The movable cylinder (2) is provided with four rollers (22) and a connecting bracket (2*a*). The connecting bracket (2*a*) is fixed at the forward end of this cylinder (2) and extends upright therefrom to a level corresponding to the cylinder rod (11) of the stationary cylinder (1). Thus, as best shown in FIG. 5, the cylinder rod (11) of stationary cylinder (1) is connected, via such bracket (2*a*), to the movable cylinder (2).

In this connection, the foregoing storage bracket (12) should also have a width greater than that of both movable cylinder (2) and its rollers (22), allowing free entry and exit of the movable cylinder (2) into and from the bracket (12) without interference therebetween.

The carriage (3) is comprised of: an inverted-L-shaped body member having an upper horizontal surface (3*c*) and a forward vertical surface (3*a*); two support leg members (30*a*)(30*a*) fixed on each of both lateral sides (3*b*)(3*b*) of the upper horizontal surface (3*c*); four rollers (30)(30) (30)(30), each being rotatably fixed to the respective lower ends of those support leg members (30*a*); and four elevation cylinders (4)(4)(4)(4) which respectively erect on the four corner portions of the upper horizontal surface (3*c*). The forward end of the movable cylinder rod (21) is fixed to the inward side of the forward vertical surface (3*a*) of the carriage body member (3*a*, 3*c*). As understandable from FIGS. 4 and 5, those body member (3*c*, 3*a*), support leg members (30*a*) and rollers (3*b*), which forms the carriage (3), cooperate with one another to define an inner storage space within which to store the two cylinders (1)(2) as well as the storage bracket (12). Accordingly, as shown typically in FIG. 4, when the present device (10) is inoperative, the first cylinder rod (11) is retracted and shortened to set the second cylinder (2) stored in the storage bracket (12), and further the second cylinder rod (12) is retracted and shortened to set the carriage (3) stored in the carriage storage section (10*a*) (see FIG. 3), while a half of both first and second cylinders (1)(2) and thus a half of the storage bracket (12) is generally stored in the above-stated inner storage space of the body member (3*c*, 3*a*), whereupon all the movable major elements are collected and juxtaposed together within the housing (10) and made compact in size.

Each of the first and second cylinders (1)(2) may be either a pneumatic cylinder or a hydraulic cylinder. Though not shown, both two cylinders (1)(2) are respectively connected with a flexible, expandable coiled tubing which supplies or draws back an air or oil into or from the corresponding one of the cylinders (1)(2), so as to extend or shorten its cylinder rod (11 or 21). The same goes for the four elevation cylinders (4)(4)(4)(4) provided at the carriage (3). This is however a matter of choice and each of those cylinders may be of an independently operable type which is controlled electronically by the robot (R).

Now, a description will be made of all the operations of the above-constructed device (10) for uncoupling and sidetracking the carrying truck (5) from the self-propelled truck (A).

Firstly, when the self-propelled truck (A) reaches a point where the whole loading and coupling system (6, 7, 8, R) and the present device (10) are located as shown in FIG. 3, the sensor (S) detects the self-propelled truck (A) and causes it to be stopped there under the computerized control of the robot (R), so that the carrying truck (5) coupled with the self-propelled truck (A) is stopped and located in a predetermined sidetracking point corresponding to the position of the present device (10).

Figure 7:
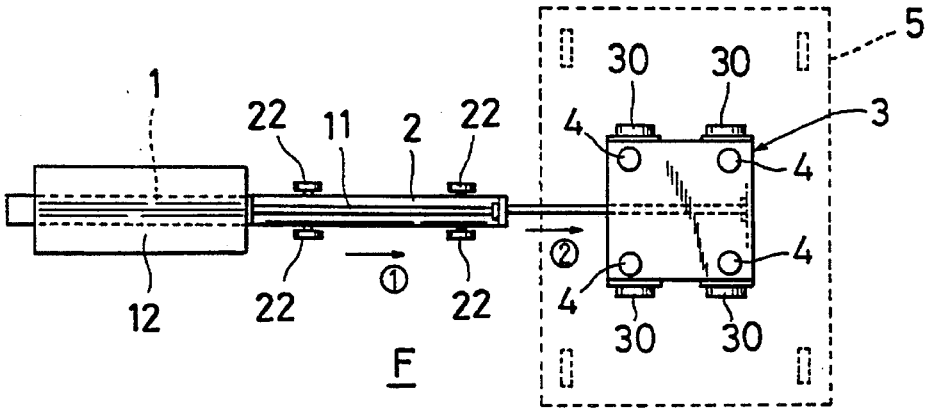
FIG. 7 is a plan view showing a telescopic motion of the sidetracking device towards the carrying truck.

Then, as shown in FIG. 7, with such detection of sensor (S), the present device (10) is operated to initially actuate the first cylinder (1) to extend its cylinder rod (11), as indicated by the arrow (①), so that both second cylinder (2) and carriage (3) are caused to be moved and stopped at a first advanced point nearer to the carrying truck (5). Thereafter, as indicated by the arrow (②), the second cylinder (2) is actuated to extend its cylinder rod (21) so as to cause the carriage (3) to be moved to a point under the carrying truck (5) (as best seen in FIG. 7), i.e. at a sidetracking point.

Figure 6:
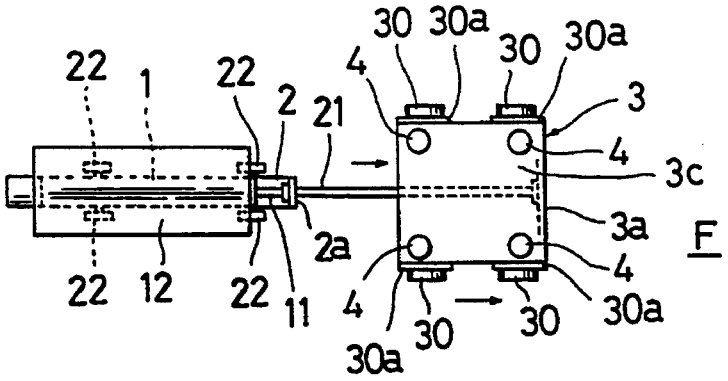
FIG. 6 is a plan view of the sidetracking device, showing its carriage to be moved.
Figure 8:
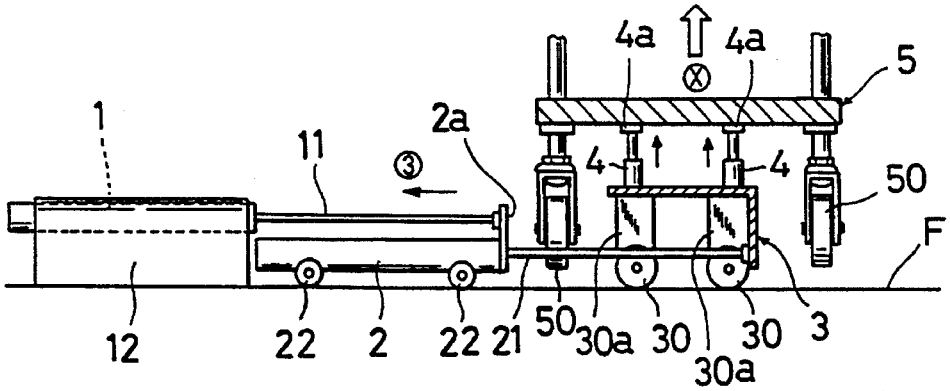
FIG. 8 is a side view showing the carrying truck to be raised by the sidetracking device.
Figure 9:
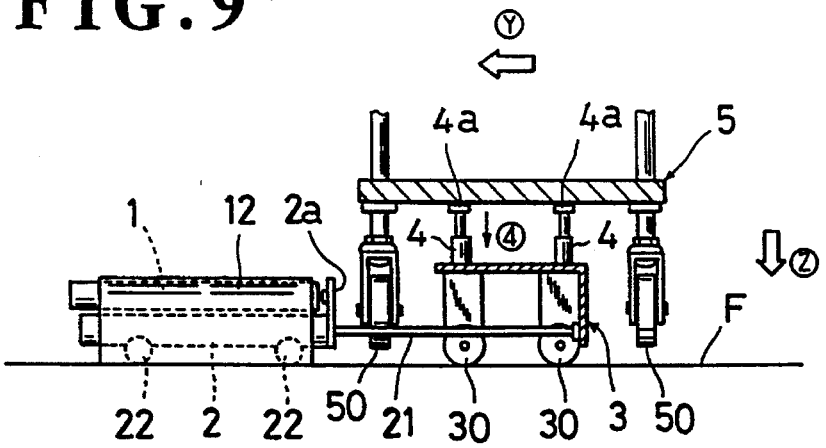
FIG. 9 is a side view showing the carrying truck to be sidetracked by the sidetracking device.

Next, as shown in FIG. 8, the four elevation cylinders (4) are all actuated simultaneously to extend upwardly their respective cylinder rods (4*a*), thereby raising the carrying truck (5) upwardly in the arrow direction (Ⓧ) to a level where the male coupler pin (5A-1) of carrying truck (5) is disengaged from the female coupler central engagement section (14*c*) of self-propelled truck (A) and the four casters (50) of carrying truck (5) are separated from the floor (F). Thereafter, the first cylinder (1) is again actuated to retract its rod (11), as indicated by the arrow (③), to draw back the second cylinder (2) into the storage bracket (12). This sidetracks the carriage (3) with the carrying truck (5) from a main track, i.e. the path (D), as indicated by the arrow (Ⓨ) in FIG. 9 and by the arrow (①) in FIG. 3, to a given sidetrack area defined by the guide rail (80) (see FIG. 3), and then the four elevation cylinders (4) are again actuated to retract and shorten their respective rods (4*a*) in the downward arrow direction (④), which lowers the truck (5) down to the floor (F) as indicated by the arrow (Ⓩ), with the casters (50) thereof in contact with the floor (F). At this point, the four cylinder rods (4*a*) of elevation cylinders (4) are shortened further away from contact with the truck (5), so that the total height of both elevation cylinders (4) and carriage (3) is made smaller than the truck (5). Then, the second cylinder (2) is operated to shorten its cylinder rod (21) to cause departure of the carriage (3) from the truck (5) as shown in FIG. 6. It is to be understood here that the carriage (3) is displaced completely out of the sidetrack area where the thus-sidetracked truck (5) lies, and returned to an initial compact state as can be seen in FIGS. 4 and 5, which therefore allows the carrying truck (5) to be moved, without hindrance of the carriage (3), to the loading and coupling section (6, 7, 8, R) (see the arrow ②in FIG. 3).

In accordance with the present invention, it is to be appreciated that, when not in use or in an inoperative state, the first and second cylinders (1)(2) and carriage (3) are juxtaposed with one another into a small compact body, as shown in FIG. 5, thus preventing the present device from taking up much of room or space in the surrounding areas of assembly shop or storehouse, while on the other hand, when in use or in operation, the two cylinders perform a telescopically extending and retracting motion to set the carriage (3) under the carrying truck (5) and sidetrack it toward a predetermined sidetrack area. Therefore, the structure of sidetracking device in accordance with the present invention is much simplified and does not require any complicated mechanical elements.

While having described the present invention as above, it should be understood that the invention is not limited to the illustrated embodiment, but any other modifications, replacements and additions may be applied structurally thereto without departing from the scopes of the appended claims. For example, instead of the first and second cylinders (1)(2), only one first cylinder (1) may be provided in combination with a belt and a belt retractor, such that the carriage (3), to which the belt is connected, may be moved, pulling the belt therebehind from the belt retractor, and set under the carrying truck (5) by a proper length of cylinder rod (11) of the first cylinder (1) and be drawn back by operation of the belt retractor to effect the side-tracking of the carrying truck (5). Further, the side-tracking device is not limited to the illustrated one designed for uncoupling and sidetracking the carrying truck (5) from the self-propelled truck (A), but applicable to any type of truck insofar as the truck itself has casters or the like which are higher than the height of the carriage (3).

What is claimed is:

1. In combination, a truck and a device for sidetracking a truck, in which the truck has a caster, comprising:

a movable actuator means operable in a direction to and from said truck;

a carriage means connected to said movable actuator means, on which carriage means said truck is to be placed, said carriage means being provided, on an upper side thereof, with a lifting means for raising said truck so that the caster of said truck may be raised away from a floor; and a stationary actuator means connected to said movable actuator means, said stationary actuator means being extendable and retractable in a direction along the direction wherein said movable actuator means is operated with respect to said truck;

wherein, in operation, said stationary actuator means is extended and retracted to move said movable actuator means to and from an operative position in which extension and retraction of said movable actuator means sets said carriage under said truck for sidetracking said truck, with said lifting means of said carriage raising said truck from the floor.

2. The combination according to claim 1, wherein said truck moves on and along a given running path and all said carriage means, movable actuator means and stationary atuator means are oriented in a direction orthogonal with said given running path.

3. The combination as defined in claim 2, wherein said movable means of said movable cylinder comprises a plurality of rollers.

4. The combination according to claim 1, wherein said truck is provided with male coupler having a downwardly projected pin to be engaged into a female engagement part of a female coupler of another truck.

5. The combination according to claim 4, wherein said another truck is a self-propelled truck for towing said truck.

6. The combination as defined in claim 1, wherein said movable actuator means comprises a movable cylinder provided with a movable means for allowing the cylinder to be moved towards and from said truck, said movable cylinder having a cylinder rod connected to said carriage, and wherein said stationary actuator means comprises a stationary cylinder fixed on said floor, said stationary cylinder having a cylinder rod connected to said movable cylinder.

7. A device for sidetracking a truck, in which the truck has a caster, comprising:

a movable actuator means operable in a direction to and from said truck;

a carriage means connected to said movable actuator means, on which carriage means said truck is to be placed, said carriage means being provided, on an upper side thereof, with a lifting means for raising said truck so that the caster of said truck may be raised away from a floor;

said carriage means having a storage space defined therein;

a stationary actuator means connected to said movable actuator means, said stationary actuator means being extendable and retractable in a direction along the direction wherein said movable actuator means is operated with respect to said truck; and said stationary actuator means including a storage bracket means within which to store said movable actuator means, wherein, when not in use, said movable actuator means is stored in said storage bracket means of said stationary actuator means and further both said movable and stationary actuator means are stored in said storage space of said carriage means, thereby making compact a whole body of the device, whereas when in use, said stationary actuator means is extended and retracted to cause said movable actuator means to be operated towards and from said truck, thereby setting said carriage under said truck and sidetracking said truck, with said lifting means of said carriage raising said truck from the floor.

8. The device according to claim 7, wherein said truck moves on and along a given running path and all said carriage means, movable actuator means and stationary actuator means are oriented in a direction orthogonal with said given running path.

9. The device as defined in claim 7, wherein said movable actuator means comprises a movable cylinder provided with a movable means for allowing the cylinder to be moved towards and from said truck, said movable cylinder having a cylinder rod at a forward end thereof facing towards said truck, which cylinder rod is connected to said carriage, wherein said movable cylinder further has an upwardly extended bracket provided at the forward end thereof, and wherein said stationary actuator means comprises a stationary cylinder having a cylinder rod at a forward end thereof facing towards said truck, which cylinder rod is connected to said upwardly extended bracket of said movable cylinder, and wherein said storage bracket means has an upper wall at which said stationary cylinder is fixed and a pair of lateral vertical walls fixed to said floor, said pair of vertical walls being higher than said movable cylinder, whereby said movable cylinder may move into and from a space within said storage bracket.

10. The device as defined in claim 7, wherein said movable means of said movable cylinder comprises a plurality of rollers.

11. The device according to claim 7, wherein said carriage means comprises a carriage including an upper wall where said lifting means is provided, a vertical frontal wall facing towards said truck and a pair of lateral sides defined between both ends of said upper wall and both ends of said vertical frontal wall, wherein said storage space is defined within all said upper wall, vertical frontal wall and pair of lateral sides of said carriage, wherein a plurality of rollers are provided on each of said pair of lateral sides of said carriage, and wherein said movable actuator means is connected at one end thereof to an inward surface of said vertical frontal wall of said carriage.

12. The device according to claim 7, wherein a total height of said carriage means and said lifting means is lower than a height of said caster of said truck.

* * * * *